United States Patent [19]

Swanson

[11] 4,280,656

[45] Jul. 28, 1981

[54] CHIMNEY HEAT ECONOMIZER

[76] Inventor: Mervin D. Swanson, 1625 13th Ave. NW., Puyallup, Wash. 98371

[21] Appl. No.: 36,228

[22] Filed: May 4, 1979

[51] Int. Cl.[3] ..... F24B 7/00

[52] U.S. Cl. ..... 237/55; 122/20 B; 126/121; 165/DIG. 2; 165/130

[58] Field of Search ..... 126/121; 237/55; 122/20 B, 1 A; 165/DIG. 2, 130

[56] References Cited

U.S. PATENT DOCUMENTS

| | | | |
|---|---|---|---|
| 2,277,381 | 3/1942 | Black | 237/51 |
| 2,331,178 | 10/1943 | Dollinger | 126/121 |
| 2,343,542 | 3/1944 | Faunce | 237/55 X |
| 2,407,590 | 10/1946 | Vineberg | 126/140 |
| 2,622,587 | 12/1952 | Dupler | 126/121 |
| 3,944,136 | 3/1976 | Huie | 237/55 |
| 4,020,823 | 3/1977 | Baumbach | 126/121 |
| 4,034,803 | 7/1977 | Reed et al. | 165/DIG. 2 |
| 4,043,313 | 8/1977 | Sherman | 126/121 |
| 4,050,627 | 9/1977 | Mayer | 237/55 |
| 4,103,735 | 8/1978 | Warner | 237/55 X |
| 4,106,290 | 8/1978 | Johnson | 98/59 X |
| 4,178,907 | 12/1979 | Sweat, Jr. | 237/55 X |
| 4,215,741 | 8/1980 | Averbuch et al. | 122/20 B X |

FOREIGN PATENT DOCUMENTS

| | | | |
|---|---|---|---|
| 108194 | 10/1967 | Denmark | 237/55 |

*Primary Examiner*—Edward G. Favors

*Attorney, Agent, or Firm*—Gregory W. Moravan; Roy E. Mattern, Jr.; David H. Deits

[57] ABSTRACT

A lightweight, modular chimney heat economizer adapted to replace a portion of the chimney for a combustion heat source in a building. The economizer includes a plurality of flue tubes having their ends welded to a pair of spaced apart tube sheets. Connected between the tube sheets and surrounding the flue tubes are inner and outer casings between which are sandwiched a layer of nonflammable insulation. The upper and lower tube sheets include outwardly extending flanges adapted to enable the economizer to be removeably secured in place so it may be easily installed and easily removed for maintenance and repair. The casings are provided with expansion joints. The top ends of the flue tubes may be flush with or recessed from the top surface of the upper tube sheet, and an upwardly projecting flange may surround the upper ends of the flue tubes to encourage condensed products from the combustion gases to drain into the flue pipes where they may be disposed of. The economizer may include baffles within the inner casing and may be adapted to have air circulated from top to bottom within the economizer to increase the thermal transfer from the flue pipes to the air circulated within the inner casing. A thermostat may be provided to maintain the temperature of the combustion gases in the flue tubes at about 350° F. to prevent products in the combustion gases, and particularly creosote, from condensing in the flue tubes. The economizer may include a water heater.

21 Claims, 11 Drawing Figures

FIG. 5
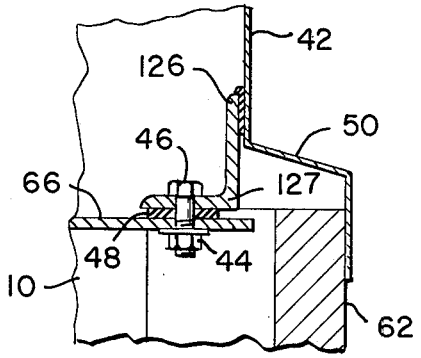
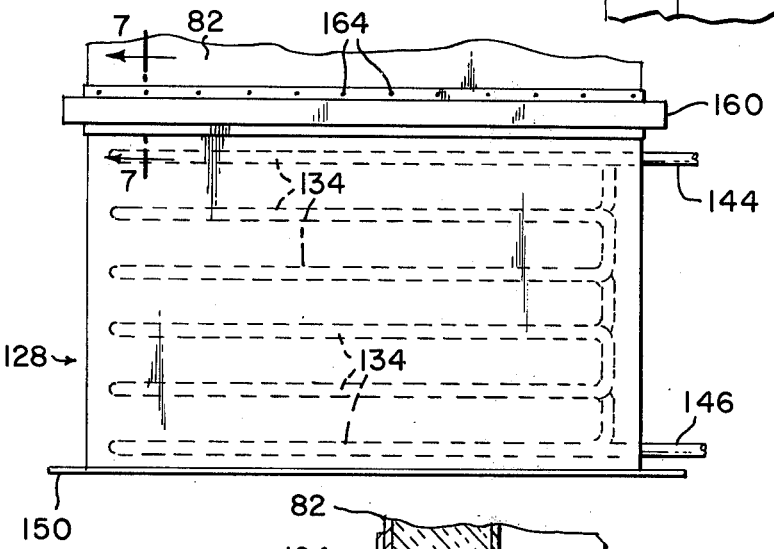
FIG. 6
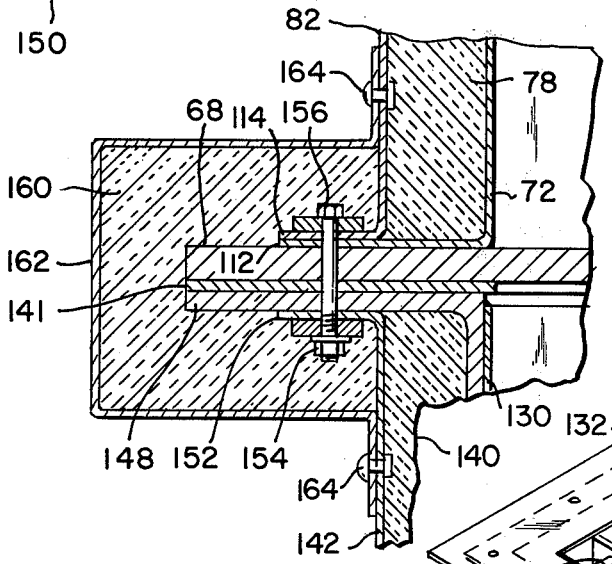
FIG. 7
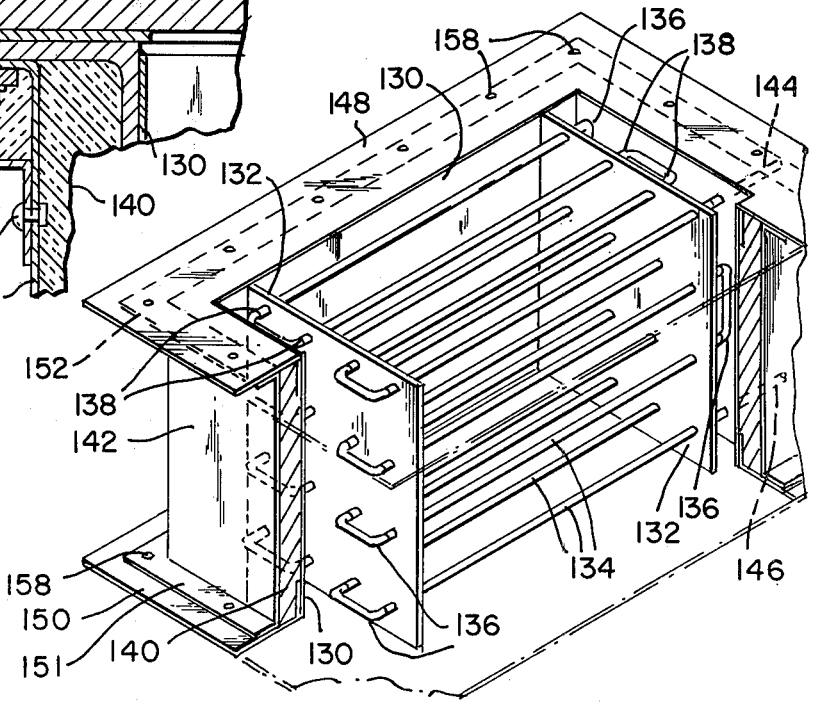
FIG. 8

CHIMNEY HEAT ECONOMIZER

BACKGROUND OF THE INVENTION

In today's world, and for the forseeable future, energy conservation is and will continue to be a matter of paramount importance. As is well known, furnaces and the like lose significant amounts of heat up the chimney. This is particularly true with respect to fireplaces in residences where a great deal of the heat energy from the fire and the warm air in the residence is wastefully expelled up the chimney. This results in the fact that a merrily blazing fire in a conventional fireplace may contribute very little net heat input into the residence and in fact may result in a net heat loss to the residence, depending on the outside air temperature.

Accordingly, one of the objects of the present is to provide a heat economizer which will extract a great deal of the heat otherwise lost up a fireplace chimney or the like, making it available for use in the building in which the economizer is located.

Other objects of the present invention are to provide an economizer which is resistant to leakage of the flue gasses therefrom, which is structurally strong, yet relatively light in weight, and which has an increased fire safety. These objects are at least partially achieved by the following aspects of the present invention. First the upper and lower ends of the flue tubes are welded to upper and lower tube sheets to provide a structurally strong, flue gas leak resistant economizer. Second, the structurally connected flue tubes and tube sheets support the inner and outer casings and the layer of nonflammable insulation sandwiched therebetween, enabling the inner and outer casings to be made from very light, thin sheet metal since they are supported by the tube sheets and flue tubes. Third, the layer of insulation and the inner and outer metal casings significantly enhance the fire safety of the economizer.

Another object of the present invention is to provide a strong, modular heat economizer which is easily transported, handled and installed, which is easily removed for repair or maintenance, and which can replace at least a portion of a conventional chimney. This object is at least partially achieved by the construction discussed above and by providing outwardly extending flanges on the tube sheets which enable the economizer to be releaseably held in place by any conventional fastener means, such as nuts and bolts. In addition, an access door may be provided in the flue or chimney above the economizer, and/or in the side wall of the building in which the economizer is installed in order to provide access to the economizer for inspection, maintenance, repair, installation, or removal.

Another object of the present invention is to provide a heat economizer which is resistant to leakage of flue gases caused by the thermal expansion and contraction of the economizer during use. This object is at least partially achieved by providing expansion joints in the inner and outer casings to help to prevent warping of the economizer and to help to prevent cracking of the welds between the flue tubes and the tube sheets.

Other objects of the present invention are to provide a heat economizer which, in effect, consumes the products of combustion which are likely to condense in the economizer, in the flue or chimney above the economizer, and on the inside of the precipitation cap covering the top of the flue or chimney; in order to reduce fire hazards, to maintain the flue tubes unobstructed, and to reduce or eliminate the unsightly and unsafe leakage of such condensation products from the flue or chimney above the economizer and from the precipitation cap. These objects are at least partially achieved by the following aspects of the present invention. First, an economizer thermostat is connected to the flue tubes and to the means for forcing air through the economizer in order to maintain the temperature of the flue tubes at least about 350° F., a temperature sufficient to prevent condensation of the products of combustion, and particularly creosote, within the flue tubes. Second, the tops of the flue tubes are welded flush with the top of the upper tube sheet, or recessed below said top, and encircled by an upstanding flange on the top of the upper tube sheet to encourage the condensation products within the flue or chimney above the economizer, and from the precipitation cap, to drain into the flue tubes where they can be evaporated by the hot combustion gases or consumed by the fire in the fireplace, furnace, or wood stove, for example. Third, the precipitation cap may include a downwardly projecting precipitation director to encourage condensation products in the cap to drain into the economizer where they can be disposed of as mentioned above.

Another object is to provide a heat economizer which efficiently exchanges the heat from the flue tubes to the air circulated within the inner casing. This object is at least partially achieved by providing baffles within the inner casing to direct the air in a tortuous path about the flue tubes and by circulating the air in the economizer in a downwardly direction generally counter to upwardly flowing combustion gases within the flue tubes.

Another object is to provide a modular water heater which also replaces a portion of the chimney above the source of combustion heat and which may be easily coupled to the economizer.

The foregoing objects, features, and advantages of the present invention which have been mentioned are by no means to be considered exhaustive. It will be appreciated that further objects, features, advantages and characteristics of the present invention will be apparent from the following more detailed description of the preferred embodiments thereof.

BRIEF DESCRIPTION OF THE FIGURES

FIG. 5 is an enlarged view of the top portion of the chimney heat economizer shown circled in FIG. 1;

FIG. 6 is a side elevational view of a modular water heater adapted to be connected to the chimney heat economizer;

FIG. 7 is an enlarged cross sectional detail view of the water heater, taken along line 7—7 of FIG. 1;

FIG. 8 is a perspective view of the water heater shown in FIG. 6, with portions broken away for clarity;

DESCRIPTION OF THE PREFERRED EMBODIMENTS

Figure 1:
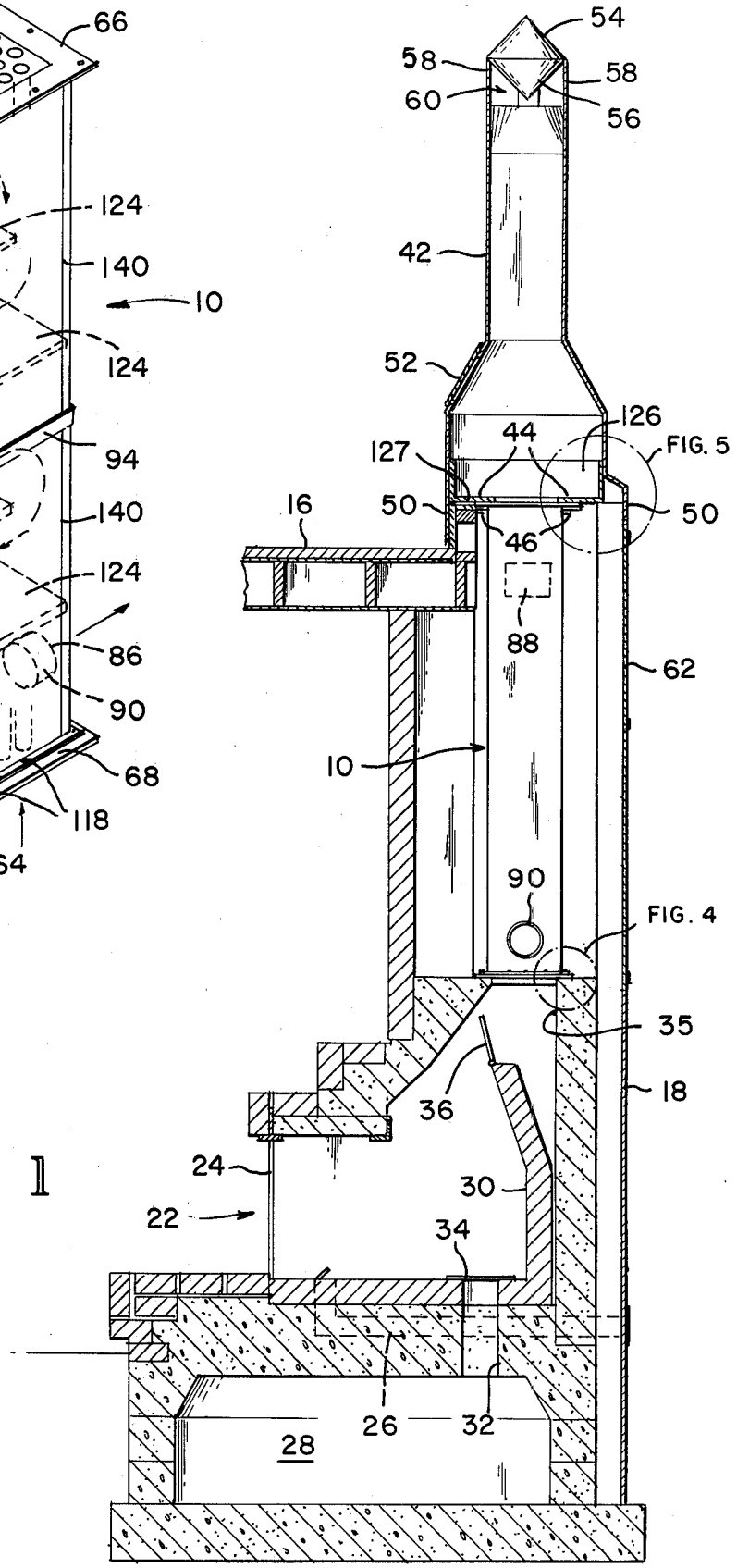
FIG. 1 is a partial cross section, elevational view of the chimney heat economizer shown in place in a dwelling.

Turning now to FIG. 1, the chimney heat economizer of the present invention, generally designated at 10, is shown, by the way of non-limiting example, installed in a home. The home has a roof 16, an exterior wall 18, and a room generally designated at 20.

Within the room 20 is a conventional fireplace, generally designated at 22, having glass doors 24, a firebox 30, a damper 36, and a combustion air supply duct 26 communicating between the exterior of the house and the firebox 30. The fireplace also includes an ash pit 28 which opens into the firebox 30 through an ash chute 32 covered by a removable ash pit door 34.

Figure 4:
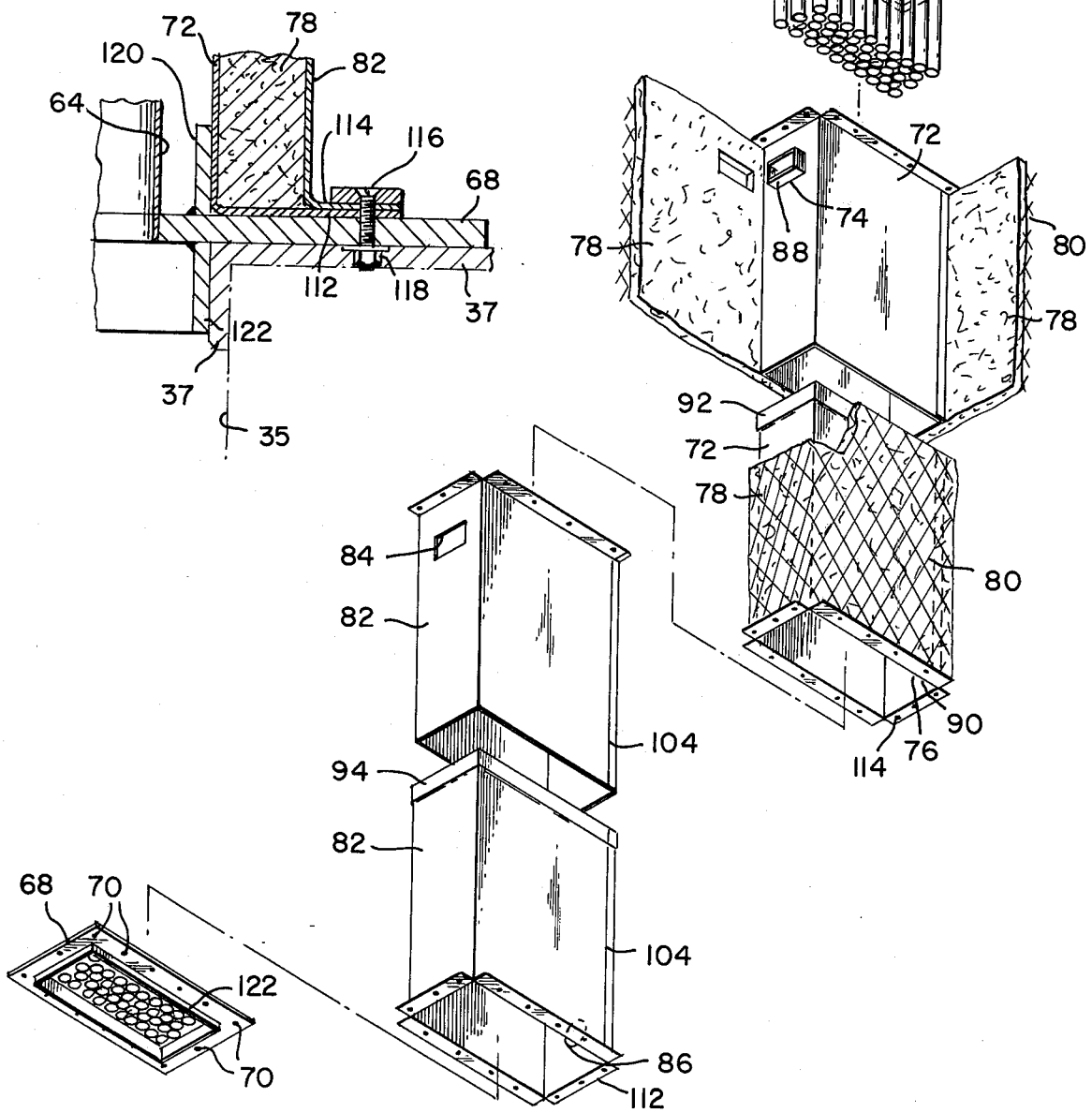
FIG. 4 is an enlarged, cross sectional view of the lower portion of the chimney heat economizer, shown circled in FIG. 1.

As seen in FIG. 4, the economizer 10 rests on the flue 35 of the fireplace 22, with a downwardly extending flange 122 extending into the flue 35. A layer of grout 37 between the economizer 10, its flange 122, and the flue 35 prevents the leakage of flue gases therebetween. No connection other than the grout 37 is needed since the weight of the economizer will hold it in place. However, the grout is weak enough to permit the convenient removal of the economizer, as for repair or replacement.

Alternately, the flue 35 of the fireplace 22 may include a plurality of upstanding studs or bolts (not illustrated) to which the lower end of the heat economizer 10 may be releaseably secured by a plurality of nuts (not illustrated). Between the bottom of the economizer 10, its flange 122, and the flue 35 is preferably placed a layer of sealing material, such as an asbestos compound, to prevent leakage of flue gases therebetween.

Although the chimney heat economizer 10 shown in FIG. 1 has substantially replaced the chimney for the fireplace 22, it is to be expressly understood that it is possible that the economizer 10 could replace only a portion thereof. As will be appreciated, the sizing of the economizer 10 may depend on such variables as the amount of space available for installation and the amount of heat output required. Of course, the size of the economizer 10 can be tailored to meet the requirements presented by nearly any situation. In addition, although the economizer 10 is shown utilized in conjunction with a fireplace 22, it is to be understood that the economizer can be utilized with any other source of heat which utilizes a combustion process, such as a furnace, wood stove, or the like, and that the economizer could have some other cross sectional shape, such as round or square.

Referring now to FIGS. 1 and 5, it is seen that an upper flue structure 42 is releaseably secured to the top of the economizer 10 with a plurality of nuts 44 and bolts 46. This construction is shown in detail in FIG. 5 wherein it is seen that again, a layer of sealing material such as an asbestos compound 48 is used to prevent leakage of flue gases between the top of the heat exchanger 10 and the angle iron flange 127 in the bottom of the upper flue structure 42.

Figure 11:
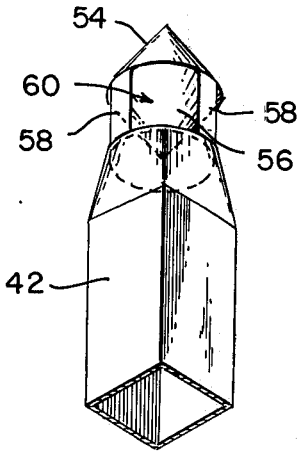
FIG. 11 is a perspective view from a lower aspect of a precipitation cap having a downwardly extending condensation director.

Referring to FIGS. 1, 5 and 11, the upper flue structure 42 includes a skirt 50 to prevent leakage of water into the dwelling; and a precipitation cap 54 to prevent precipitation from directly entering the upper flue structure 42. As seen, the cap 54 is mounted to the upper flue structure 42 by a plurality of legs 58 to provide a plurality of openings 60 which permit exit of the flue gases from the upper flue structure 42.

Referring again to FIG. 1, the upper flue structure 42 preferably includes an access door 52 to provide access to the top of the economizer 10 so that the upper flue structure 42 can be conveniently assembled thereto or disassembled therefrom, as with the nuts 44 and bolts 46. Thus, the door 52 permits access to the economizer 10 for inspection, maintenance and cleaning and also permits the easy removal of the upper flue structure 42 for similar purposes.

The exterior wall 18 of the house may also include an access door 62 which, when opened, will permit access to the heat economizer 10 for installation, and for removal for maintenance, repair, or replacement. it will be appreciated that in order to remove the economizer 10, the nuts 44 are first removed from the top of the economizer 10 through the access door 52. Next, the upper flue structure 42 is removed. Then the economizer 10 can be removed from the building by either lifting it vertically out of the building, as with a crane, or by extracting it sideways from the building, through the access door 62. If studs or bolts and nuts were used to secure the lower end of the economizer 10 to the flue opening 35, as was previously described, the nuts can be removed through the access provided by the door 62, thereby releasing the base of the economizer and permitting its removal as was described above. The manner of installing the economizer 10 will be apparent from the foregoing.

Figure 2:
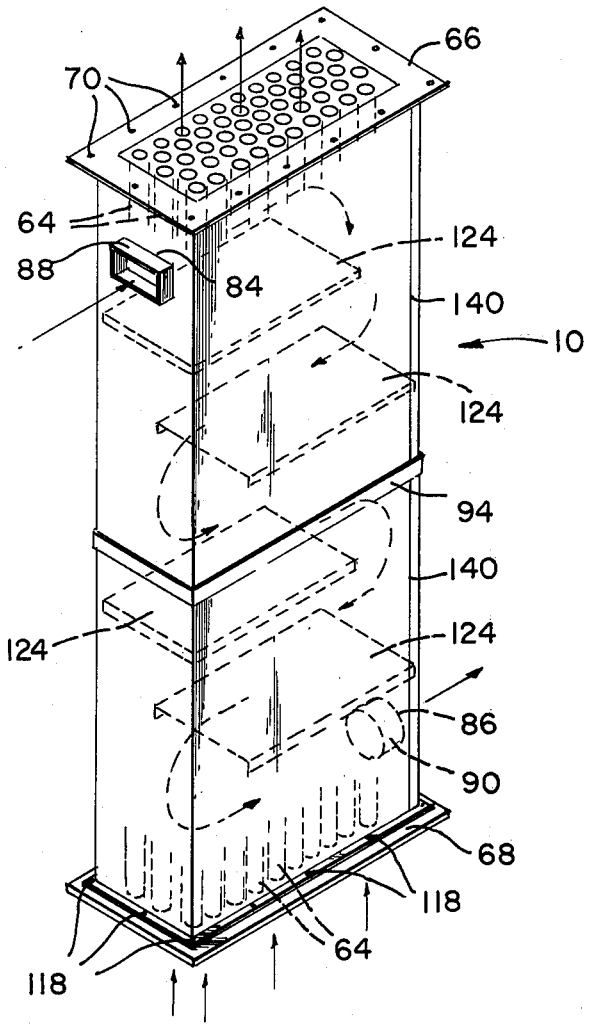
FIG. 2 is a perspective view of the chimney heat economizer with certain portions thereof shown broken away and in phantom for clarity.
Figure 3:
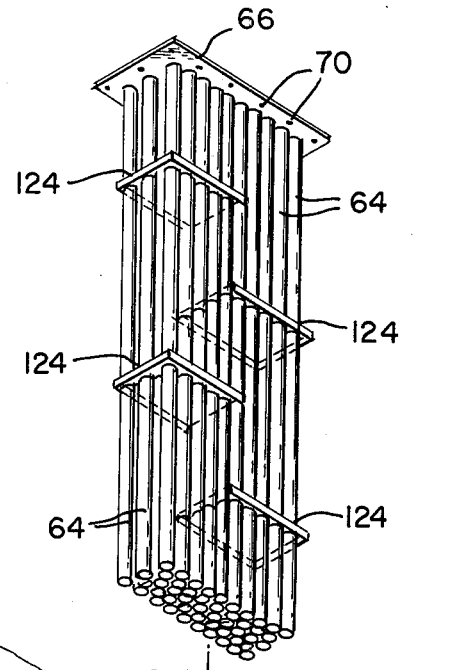
FIG. 3 is an exploded, perspective view of the chimney heat economizer.

Referring now to FIGS. 2 and 3, a detailed description of the chimney heat economizer 10 of the present invention will now be given. By way of example, the economizer may be about seven feet tall; two feet, three inches wide; and about one foot, one and one-half inches thick. The economizer 10 shown includes, by way of example, fifty two-inch flue tubes 64.

As has been mentioned, the size of the economizer may be varied to suit the needs of the particular situation encountered. Similarly, the heat output of the economizer can be selectively varied, without changing the overall dimensions of the economizer 10, by suitably selecting the number and diameter of the flue tubes 64.

As seen, the upper and lower ends of the flue tubes 64 are secured, as by welding, to the one-quarter inch thick upper and lower tube sheets 66, 68, respectively, so that the flue tubes 64 can provide fluid communication between the tube sheets 66, 68 for the combustion gases from the fireplace 22. Each end of each flue tube 64 is welded completely about its periphery to its respective tube sheet 66, 68 in order to provide structural rigidity and strength and to prevent leakage of flue or combustion gases from the flue tubes. Preferably, the combined cross-sectional area of the flue tubes 64 is about equal to 1/10 of the area of the fireplace opening, in order to provide an adequate exit for the flue or combustion gases from the fireplace 22.

As illustrated in FIGS. 2 and 3, each tube sheet 66, 68 extends outwardly from the outer casing 82, with the upper tube sheet including a plurality of mounting holes 70. The holes 70 in the upper tube sheet 66, in combination with the nuts and bolts 44, 46, are used to releaseably secure the upper flue structure 42 to the top of the economizer, as was described above. Similarly, holes 70 may be provided in the lower tube sheet if it is desired to releaseably secure the economizer to the flue opening 35 with studs or bolts and nuts as was previously described.

The flue tubes 64 are enclosed by an inner casing 72 having an inlet opening 74 and an outlet opening 76. Surrounding the inner casing 72 is a layer of non-flammable insulation 78, such as one inch of mineral wool batts held in place and reinforced by wire screening 80.

Encircling the layer of insulation 78 and the screening 80 is an outer casing 82 having an inlet opening 84 and an outlet opening 86. Communicating between the inlet openings 74, 84 and the outlet openings 76, 86 of the inner and outer casings are an inlet duct 88 and an outlet duct 90, respectively.

Both the inner and outer casings 72, 82 are preferably made from twenty gauge or lighter, galvanized, mild steel sheet metal. Sheet metal of such a light weight can be used to fabricate the inner and outer casings 72, 82 because the welded construction of the flue tubes 64 and the tube sheets 66, 68 provides the economizer 10 with all the requisite structural strength and integrity, with the inner and outer casings 72, 82 serving merely to enclose the flue tubes 64 and to support the insulation 78. As will be appreciated, the layer of insulation 78, in combination with the inner and outer casings, 72, 82, provides the economizer 10 with an enhanced fire safety, permitting it to be installed within three inches of a combustible surface in accordance with most fire codes.

Figure 10:
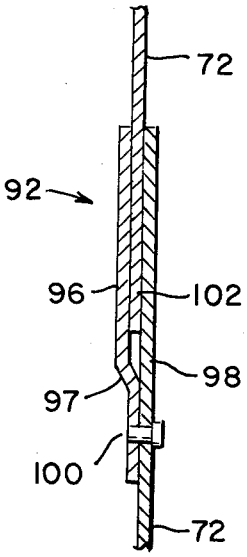
FIG. 10 is a cross sectional view of the expansion joint used in the inner and outer casings of the chimney heat economizer.

Both the inner and outer casings 72, 82 are made in upper and lower halves, as best seen in FIG. 3, and have at their midpoints expansion joints 92, 94, respectively, which permit the thermal expansion and contraction of the economizer 10 while greatly reducing any undesirable warping of the economizer or cracking of the welds between the ends of the flue tubes 64 and the tube sheets 66, 68. The construction of the expansion joints 92, 94 is identical, with FIG. 10 showing an enlarged detail of the expansion joint 92. As seen in FIG. 10, the expansion joint 92 simply comprises a strip of metal 96, having a dogleg 97, which is secured to the upper end 98 of the lower half of the inner casing 72 by a plurality of pop rivets 100. The lower end 102 of the upper half of the inner casing 72 fits with a snug friction fit into the space provided by the dogleg 97 between the strip of metal 96 and the upper end 98 of the lower half of the inner casing 72.

Figure 9:
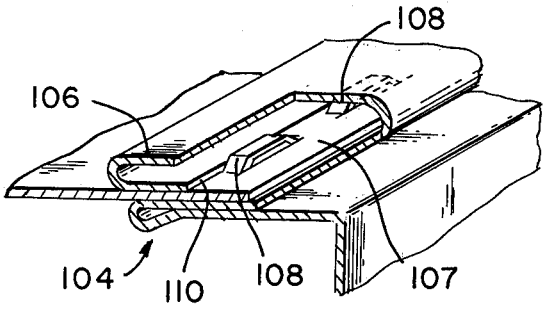
FIG. 9 is a perspective view, with portions broken away for clarity, of the Pittsburg joint used to form the respective inner and outer casings of the chimney heat economizer.

Each upper and lower half of both of the inner and outer casings 72, 82 is preferably formed from one length of sheet metal having its end portions 106, 107 secured together with a plurality of Pittsburg joints 104, shown in detail in FIG. 9. As seen, each Pittsburg joint 104 is formed by looping over on itself one end portion 106 in the manner shown in FIG. 9. The other end portion 107 of the sheet metal has stamped therein a plurality of dogs 108 which, when inserted into the looped over end portion 106, are restrained by an abutting edge 110 of the end portion 106.

Referring now to FIG. 4, the manner in which the ends of the inner and outer casings 72, 82 are secured to their respective tube sheets 66, 68 will now be discussed. In FIG. 4 the manner of connecting the lower ends of the inner and outer casings 72, 82 to the lower tube sheet 68 is shown by way of example, it being understood that the manner of connecting the upper ends of the inner and outer casings 72, 82 to the upper tube sheet 66 is substantially identical. As seen in FIG. 4, both the inner and outer casings 72, 82 have an outwardly extending flange 112, 114, respectively. The flanges 112, 114 are then secured to the tube sheet 68 by a plurality of screws 116 and nuts 118; the junction between the flange 112 and the tube sheet 68 being sealed with any heat resistant sealer, such as an asbestos compound.

Preferably, both the upper and lower tube sheets 66, 68 include an inwardly extending flange 120 used to position and reinforce the lower ends of the inner and outer casings 72, 82. As seen in FIG. 4, the lower tube sheet 68 also includes an outwardly extending locating flange 122 which is used to center the economizer 10 in the flue opening 35 of the fireplace 22, as was previously discussed.

Referring again to FIGS. 1 and 3, it is seen that the economizer 10 includes a plurality of spaced apart, staggered baffles 124 secured to the inner casing 72 by any suitable means, such as pop rivets. As will be appreciated, the baffles 124 force the air which is circulated through the economizer 10 to travel in a tortuous path, thereby increasing the efficiency of thermal transfer between the outer walls of the flue tubes 64 and the air which is circulated within the exchanger 10. Preferably, air is circulated through the exchanger into the inlet duct 88, about the baffles 124, and out through the outlet duct 90 by means of any air driving means, such as a squirrel cage blower, not shown, which can be connected to either the inlet duct 88 or to the outlet duct 90. Preferably, the blower is arranged such that the air within the heat exchanger circulates from the top thereof from the inlet duct 88 downwardly to the outlet duct 90. That is, in a downwardly direction generally counter to the upwardly flowing flue gases within the flue tubes 64, to thereby increase the efficiency of the transfer of thermal energy from the flue tubes 64 to the air circulated within the economizer 10.

Referring now to FIG. 1, it is of course understood that the inlet duct 88 and the outlet duct 90 are connected to the cold air return ducting and to the warm air distribution ducting, respectively, in the building in which the economizer is located. The cold air return ducting and the warm air distribution ducting can be of any conventional form and, for clarity, are not shown in FIG. 1. However, preferably the cold air return ducting has its inlets adjacent the ceilings of the rooms in the building, while the warm air distribution ducting discharges warm air into the rooms through floor mounted outlets. Such an arrangement prevents the undesirable buildup of warm air near the ceilings and enhances the economizer 10's ability to maintain the temperature of the rooms at a uniform level.

Turning now to other matters, the upper ends of the flue tubes 64 are preferably flush or slightly recessed into the upper surface of the upper tube sheet 66. In addition, as shown in FIGS. 1 and 5, the upper ends of the flue tubes 64 are encircled by an upwardly extending flange 126 which is provided by the angle iron member 127 connected between the upper flue structure 42 and the economizer 10. The function of the flange, as well as the function of the flush mounting or recessing of the upper ends of the flue tubes 64 with respect to the upper surface of the upper tube sheet 66, is to help to ensure that any products of the combustion gases from the fire in the fireplace 22 which condense on the inner surfaces of the upper flue structure 42 will not drain outwardly on the exterior of the upper flue structure 42 or on the exterior of the building, but will instead, be encouraged to drain into the flue tubes 64 where they can be evaporated by the hot combustion gases or consumed by the fire in the fireplace 22.

Similarly, in order to prevent the products of the combustion gases which may condense on the inner surfaces of the precipitation cap 54 from running down the exterior of the upper flue structure 42, a downwardly extending conical director 56 has been secured to the inner surface of the cap 54 so that the condensation products will drain down into the upper flue structure 42, to be disposed of in the manner described above.

In order to prevent the undesirable buildup of the products of the combustion gases which may condense on or drain into the flue tubes 64, it is preferred that the means for driving air through the economizer 10, not illustrated, be controlled by an economizer thermostat means of conventional construction, also not illustrated, which is connected to both the economizer 10 and to the air driving means. The economizer thermostat means is arranged to maintain the temperature of the upper portions of the flue tubes 64 at a predetermined temperature. Preferably the preselected temperature is at least about 350° F. in order to prevent the condensation of products in the combustion gases within the flue tubes 64 and in particular, creosote. Of course, such a temperature will also likely evaporate any condensation products which drain into the flue tubes.

Preventing a buildup of creosote, or other condensation products of the combustion gases in the flue tubes 64 is important since an undesirable buildup of such products may present both a fire hazard and may obstruct the passage of the combustion gases through the flue tubes 64.

Naturally, the economizer thermostat means is arranged such that when the detected temperature of the flue tubes 64 is below 350° F, the means for driving air through the economizer 10 are turned down or even off until the temperature of the flue tubes rises to the desired temperature. Once a temperature of 350° F. is reached, the economizer thermostat means detects this event and will permit the air driving means to be turned on or turned up.

Of course, the conventional room thermostat means within the building are also coupled to the means for driving air through the economizer 10 in a way such that when the building is below the desired temperature, the air driving means are turned on or turned up, and when the building reaches the desired temperature, the air driving means are turned down or turned off. However, the economizer thermostat means and the room thermostat means are arranged so that the room thermostat is unable to turn on or turn up the air driving means until the temperature of the upper portions of the flue tubes reaches about 350° F.

If an economizer thermostat means, as discussed above, is used to maintain the temperature of the upper portions of the flue tubes at about 350° F., it is preferred that a plenum, not illustrated, be connected to the outlet duct 90 of the economizer. The plenum should have, besides an inlet connected to the outlet duct 90, a room air inlet permitting the introduction into the plenum of cooler air from the interior of the building, and an outlet for discharging warmer air from the plenum into the building's warm air distribution system.

Preferably, the plenum includes a plenum thermostat means, of conventional construction, not illustrated, connected so as to drive an air control door in the room air inlet of the plenum. The plenum thermostat means is arranged so as to insure that the temperature of the air within the plenum's outlet is not higher than a predetermined temperature to reduce any fire hazard which might be caused by the economizer thermostat which maintains the temperature of the flue tubes 64 at about 350° F. This is done by arranging the plenum thermostat means to open said air control door when the air in the outlet of the plenum exceeds a predetermined temperature, and to close said air control door when the air in the plenum is below said predetermined temperature. Naturally, cool air from the house is supplied under pressure to the room air inlet of the plenum, as through a duct from the economizer's air driving means.

Turning now to FIGS. 6–8, a modular water heater 128 is illustrated which is adapted to replace a portion of the chimney normally found above a source of combustion heat, such as a fireplace 22. The water heater comprises a four-sided inner casing 130 within which are secured a pair of inner walls 132 between which are supported a plurality of pieces of water pipe 134. The water pipes 134 are joined to form one continuous pipe by a plurality of C-shaped connections 136 which interconnect the ends of the water pipes 134 by silver soldered joints 138. When the water heater 128 is installed, hot combustion gases pass upwardly within the inner casing 130, on both sides of each inner wall 132.

Surrounding the inner casing 130 and the connections 136 is a layer of non-flammable insulation 140 such as one inch mineral wool batts. Enclosing the insulation 140 and the inner casing 130 is an outer casing 142. Penetrating the inner and outer casings 130, 142 and the insulation 140 are a cold water inlet 144 and a hot water outlet 146. Preferably, the water inlet 144 is at the top of the water heater 128 and the water outlet 146 is at the bottom of the water heater so that the water circulates generally downwardly through the water heater, that is in a direction generally counter to that of the upwardly flowing combustion gases within the inner casing 130.

The upper and lower edges of the inner casing 130 are welded to upper and lower angle iron flanges 148, 150; respectively, which flanges extend completely about the upper and lower edges of the inner casing 130. The flange 148 on the top of the inner casing 130 is joined to the flange 152 on the top of the outer casing by any suitable means such as by a bolt 156 passing therethrough which is secured with a nut 154. This arrangement is shown generally in FIG. 7. In a like manner, the flange 150 on the bottom of the inner casing 130 is secured to a flange 151 on the bottom of the outer casing.

As seen in FIG. 8, both the top flanges 148, 152 and the bottom flanges 150, 151 are provided with a plurality of fastening holes 158 through which fasteners are passed to secure the respective flanges on the inner and outer casings together. The holes 158 are also adapted to be used to secure the water heater 128 in its working location as a substitute for a part of the chimney above a source of combustion heat such as a fireplace, furnace or the like; or the bottom of the water heater 128 may simply be grouted in place, much as was described with respect to the economizer 10 in FIG. 1.

Turning now to FIG. 7, it will now be explained how the fastening holes 158 can also be used to join the modular water heater 128 to the lower end of the economizer 10. As seen, a plurality of nuts 154 and bolts 156 hold both the economizer 10 and the water heater 128 in an assembled relation by securing together the flanges 112, 114 on the inner and outer casings of the economizer, the lower tube sheet 68 of the economizer, and the flanges 148, 152 on the inner and outer casings of the water heater 128. Between the lower tube sheet 68 of the economizer and the flange 148 on the water heater is placed a layer of sealing material 141, such as an asbestos compound, to prevent the leakage of flue gases. Surrounding the juncture between the economizer 10 and the water heater 128 is a layer of insulation 160 held in place by a protective guard 162 affixed to the outer casings 82, 142 of the economizer and the water heater, respectively, by plurality of pop rivets 164.

From the foregoing, various further applications, modifications and adaptations of the apparatus disclosed by the foregoing preferred embodiments of the present invention will be apparent to those skilled in the art to which the present invention is addressed, within the scope of the following claims.

I claim:

1. An improved, modular chimney heat economizer of the type adapted to replace at least a portion of a chimney in a building and of the type comprising:

a plurality of flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes; and an inlet and outlet in said inner casing in fluid communication with the interior of said inner casing;

wherein the improvement comprises:

a layer of nonflammable insulation at least partially covering the exterior of said inner casing;

an outer sheet metal casing connected between said tube sheets, said outer casing having an inlet and an outlet and encircling both said inner casing and said layer of insulation;

an inlet and an outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets; and wherein the ends of said flue tubes are welded to said tube sheets and said economizer comprises inner and outer expansion joint means in said inner and outer casings, respectively, to prevent warping of said economizer and to prevent cracking of said welds which might otherwise cause leakage of flue gases from said economizer during the repeated thermal expansion and contraction of said economizer during usage thereof.

2. An improved, modular chimney heat economizer of the type adapted to replace at least a portion of a chimney in a building and of the type comprising:

a plurality of flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes; and an inlet and outlet in said inner casing in fluid communication with the interior of said inner casing;

wherein the improvement comprises:

a layer of nonflammable insulation at least partially covering the exterior of said inner casing;

an outer sheet metal casing connected between said tube sheets, said outer casing having an inlet and an outlet and encircling both said inner casing and said layer of insulation;

an inlet and an outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets; and upper and lower mounting flanges extending outwardly from said upper and lower tube sheets, respectively, wherein said upper mounting flange is adapted to be removably connected to an upper flue means with removable fastener means and said lower mounting flange is adapted to be removably connected to a lower flue means by removable fastener means to enable said modular chimney heat economizer and said upper flue means to be easily installed, and removed, and to enable said upper flue means to be easily removed for maintenance and repair of said economizer.

3. An improved, modular chimney heat economizer of the type adapted to replace at least a portion of a chimney in a building and of the type comprising:

a plurality of flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes; and an inlet and outlet in said inner casing in fluid communication with the interior of said inner casing;

wherein the improvement comprises:

a layer of nonflammable insulation at least partially covering the exterior of said inner casing;

an outer sheet metal casing connected between said tube sheets, said outer casing having an inlet and an outlet and encircling both said inner casing and said layer of insulation;

an inlet and an outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets; and an upper flue means removably connected to said upper tube sheet with removable fastener means, said upper flue means including an access door positioned to permit inspection and cleaning of said flue tubes, and to permit the engaging and disengaging of said removable fastener means to permit the easy installation and removal of said upper flue means and said economizer.

4. An improved, modular chimney heat economizer of the type adapted to replace at least a portion of a chimney in a building and of the type comprising:

a plurality of flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes; and an inlet and outlet in said inner casing in fluid communication with the interior of said inner casing;

wherein the improvement comprises:

a layer of nonflammable insulation at least partially covering the exterior of said inner casing;

an outer sheet metal casing connected between said tube sheets, said outer casing having an inlet and an outlet and encircling both said inner casing and said layer of insulation;

an inlet and an outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets; and one outside wall of said building, said outside wall being adjacent said economizer and having an access door to permit the easy installation of said economizer and to permit the easy removal thereof for maintenance and repair.

5. An improved, modular chimney heat economizer of the type adapted to replace at least a portion of a chimney in a building and of the type comprising:

a plurality of flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes; and an inlet and outlet in said inner casing in fluid communication with the interior of said inner casing;

wherein the improvement comprises:

a layer of nonflammable insulation at least partially covering the exterior of said inner casing;

an outer sheet metal casing connected between said tube sheets, said outer casing having an inlet and an outlet and encircling both said inner casing and said layer of insulation;

an inlet and an outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets; and wherein the upper tube sheet is adapted to be connected to an upper flue means in fluid communication with said flue tubes, and wherein the upper ends of the flue tubes are recessed below the top surface of said upper tube sheet, to encourage any products of said combustion gases which condense in said upper flue means to drain into said flue tubes to prevent said condensation products from leaking from said upper flue means.

6. An improved, modular chimney heat economizer of the type adapted to replace at least a portion of a chimney in a building and of the type comprising:

a plurality of flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes; and an inlet and outlet in said inner casing in fluid communication with the interior of said inner casing;

wherein the improvement comprises:

a layer of nonflammable insulation at least partially covering the exterior of said inner casing;

an outer sheet metal casing connected between said tube sheets, said outer casing having an inlet and an outlet and encircling both said inner casing and said layer of insulation;

an inlet and an outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets; and wherein the upper tube sheet is adapted to be connected to an upper flue means in fluid communication with said flue tubes, and wherein said economizer further comprises an upstanding flange secured to the top surface of said upper tube sheet and at least partially encircling the upper ends of said flue tubes, to encourage any products of said combustion gases which condense in said upper flue means to drain into said flue tubes to prevent said condensation products from leaking from said upper flue means.

7. An improved, modular chimney heat economizer of the type adapted to replace at least a portion of a chimney in a building and of the type comprising:

a plurality of flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes; and an inlet and outlet in said inner casing in fluid communication with the interior of said inner casing;

wherein the improvement comprises:

a layer of nonflammable insulation at least partially covering the exterior of said inner casing;

an outer sheet metal casing connected between said tube sheets, said outer casing having an inlet and an outlet and encircling both said inner casing and said layer of insulation;

an inlet and an outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets; and wherein the upper and the lower ends of said inner and outer casings each include a casing flange, wherein said casing flanges are overlapped, and the overlapped portions of said casing flanges are joined together to permit the easy securing of the upper and lower ends of said inner and outer casings to their respective tube sheets.

8. An improved, modular chimney heat economizer of the type adapted to replace at least a portion of a chimney in a building and of the type comprising:

a plurality of flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes; and an inlet and outlet in said inner casing in fluid communication with the interior of said inner casing;

wherein the improvement comprises:

a layer of nonflammable insulation at least partially covering the exterior of said inner casing;

an outer sheet metal casing connected between said tube sheets, said outer casing having an inlet and an outlet and encircling both said inner casing and said layer of insulation;

an inlet and outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets;

air moving means connected to one of said inlet and said outlet ducts to circulate air within said inner casing and about the exteriors of said flue tubes, and a first theremostat means connected to said economizer and to said air moving means to regulate the amount of said circulated air to maintain the temperature of the upper portions of said flue tubes at at least about 350° F. to prevent the undesirable condensation of products, and particularly creosote, from the combustion gases within said flue tubes, which might otherwise accumulate in said flue tubes to a degree requiring the costly cleaning of said flue tubes to prevent a fire hazard and to maintain the unrestricted flow of combustion gases through said flue tubes; and a plenum, said plenum having an outlet, one inlet connected to said outlet duct of the economizer, a second inlet adapted to receive air from a source of air cooler than the air received from the outlet of said economizer, and air control means within said second inlet, said economizer further comprising a second thermostat means connected to said plenum's outlet and to said air control means to maintain the temperature of the air in said plenum's outlet below about a predetermined temperature for fire safety reasons and despite said first thermostat means maintaining the temperature of said flue tubes at at least about 350° F.

9. An improved, modular chimney heat economizer of the type adapted to replace at least a portion of a chimney in a building and of the type comprising:

a plurality of genrally vertically oriented flue tubes adapted to receive therethrough hot combustion gases;

spaced apart upper and lower tube sheets between which are secured said plurality of flue tubes, the ends of said plurality of flue tubes penetrating said upper and lower tube sheets to provide fluid communication therethrough;

an inner sheet metal casing connected between said tube sheets and encircling said plurality of flue tubes to form a substantially air tight enclosure for said flue tubes; and an inlet and outlet in said inner casing in fluid communication with the interior of said inner casing;

wherein the improvement comprises:

a layer of nonflammable insulation covering substantially all of the exterior of said inner casing;

an outer sheet metal casing connected between said tube sheets, said outer casing having an inlet and an outlet and encircling both said inner casing and said layer of insulation; and an inlet and an outlet duct connected respectively between the inlets and outlets of said inner and outer casings to provide fluid communication between the exterior of said economizer and the interior of said inner casing, wherein said inner and outer casings and said insulation significantly increase the fire safety of said economizer and said inner and outer casings are supported by said flue tubes through said upper and lower tube sheets.

10. The economizer according to claim 1, wherein the upper and lower ends of said flue tubes are completely welded to said upper and lower tube sheets, respectively, to provide an economizer which is less likely to leak said combustion gases, and to provide an economizer of great structural strength and integrity to enable it to be easily transported, handled, and installed; and removed for maintenance and repair with a lesser chance of damage thereto.

11. The economizer according to claim 2, wherein due to the great structural strength and integrity provided by said flue tubes being completely welded to said tube sheets, said inner and outer casings are made from very lightweight sheet metal since said casings carry no significant loading, but are instead supported by said tube sheets; resulting in a lighter weight economizer more easily transported, handled and installed; and removed for maintenance and repair.

12. The economizer according to claim 1 or 2, further comprising an upper flue means removably connected to said upper tube sheet with removable fastener means, said upper flue means including an access door positioned to permit inspection and cleaning of said economizer, and in particular to permit the inspection and cleaning of said flue tubes, and to permit the engaging and disengaging of said removable fastener means to permit the easy installation and removal of said upper flue means and said economizer.

13. The economizer according to claims 1 or 2, or 12, further comprising one outside wall of said building, said outside wall being adjacent said economizer and having an access door to permit the easy installation of said economizer and to permit the easy removal thereof for maintenance and repair.

14. The economizer according to claim 1, wherein the upper tube sheet is adapted to connected to an upper flue means in fluid communication with said flue tubes, and wherein the upper ends of the flue tubes are flush with the top surface of said upper tube sheet, to encourage any products of said combustion gases which condense in said upper flue means to drain into said flue tubes to prevent said condensation products from leaking from said upper flue means.

15. The economizer according to claim 1, further comprising an upper flue means in fluid communication with said flue tubes, wherein said upper flue means includes an immobile precipitation cap having a downwardly projecting precipitation director to encourage any condensation products of said combustion gases which might otherwise condense on the inner surface of said precipitation cap and run down the exterior surfaces of said upper flue means to instead be directed by the precipitation director to drain downwardly within said upper flue means.

16. The economizer according to claim 1, further comprising air moving means connected to one of said inlet and outlet ducts, and arranged to circulate air generally downwardly within said inner casing in a direction generally counter to the upwardly movement of said combustion gases within said flue tubes to increse the heat transfer efficiency between said air and said flue tubes.

17. The chimney heat economizer according to claims 1 or 2, further comprising a plurality of spaced apart, staggered baffles located within said inner casing wherein said baffles extend around at least some of said flue tubes, and wherein said baffles are for directing the air flowing within said inner casing in a tortuous path about said flue tubes to increase the heat transfer efficiency between said air and said flue tubes.

18. The economizer according to claim 1, further comprising air moving means connected to one of said inlet and said outlet ducts to circulate air within said inner casing and about the exteriors of said flue tubes, and a first thermostat means connected to said economizer and to said air moving means to regulate during use, the amount of said circulated air to maintain the temperature of the upper portions of said flue tubes at at least about 350° F. to prevent the undesirable condensation of products, and particularly creosote, from the combustion gases within said flue tubes, which might otherwise accumulate in said flue tubes to a degree requiring the costly cleaning of said flue tubes to prevent a fire hazard and to maintain the unrestricted flow of combustion gases through said flue tubes.

19. The chimney heat economizer according to claim 1, further comprising a water heating means connected to one of said upper and lower tube sheets.

20. The chimney heat economizer according to claim 19, wherein said water heating means comprises an inner water heater casing within which are located two inner walls each carrying a plurality of sections of water pipe joined together by a plurality of connections, wherein each connection comprises a length of connecting pipe sealingly connected to the respective ends of its respective water pipes.

21. The chimney heat economizer according to claim 20, further comprising a layer of nonflammable insulation at least partially surrounding said inner water heater casing, said layer of insulation and said inner water heater casing being surrounded by an outer water heater casing to significantly increase the fire safety of said water heating means.

* * * * *